US006916409B1

(12) United States Patent
Callol et al.

(10) Patent No.: US 6,916,409 B1
(45) Date of Patent: Jul. 12, 2005

(54) APPARATUS AND PROCESS FOR ELECTROLYTIC REMOVAL OF MATERIAL FROM A MEDICAL DEVICE

(75) Inventors: Joseph R. Callol, San Francisco, CA (US); Karim Said Osman, Mountain View, CA (US); Napoleon L. Caliguiran, Union City, CA (US); Rommel C. Lumauig, San Jose, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 209 days.

(21) Appl. No.: 10/335,549

(22) Filed: Dec. 31, 2002

(51) Int. Cl.[7] ..... C25F 3/14; C25F 7/00
(52) U.S. Cl. ..... 204/297.05; 204/279; 204/285
(58) Field of Search ..... 204/279, 285, 204/297.05; 205/666

(56) References Cited

U.S. PATENT DOCUMENTS

| | | | | |
|---|---|---|---|---|
| 4,048,048 A | | 9/1977 | Bennett et al. | |
| 4,053,977 A | * | 10/1977 | Simon et al. | 29/33 |
| 5,098,542 A | * | 3/1992 | Reinhardt et al. | 204/297.05 |
| 5,192,307 A | * | 3/1993 | Wall | 623/1.2 |
| 5,217,586 A | | 6/1993 | Datta et al. | |
| 5,843,164 A | | 12/1998 | Frantzen et al. | |
| 5,972,180 A | | 10/1999 | Chujo | |
| 6,197,048 B1 | | 3/2001 | Richter | |
| 6,258,116 B1 | | 7/2001 | Hojeibane | |
| 6,264,687 B1 | | 7/2001 | Tomonto | |
| 6,325,825 B1 | | 12/2001 | Kula et al. | |
| 6,344,055 B1 | | 2/2002 | Shukov | |
| 6,387,807 B1 | | 5/2002 | Faubert et al. | |
| 6,436,104 B2 | | 8/2002 | Hojeibane | |
| 6,440,295 B1 | | 8/2002 | Wang | |
| 6,518,603 B1 | | 2/2003 | Schmuki et al. | |
| 6,565,729 B2 | | 5/2003 | Chen et al. | |
| 6,566,235 B2 | | 5/2003 | Nishida et al. | |
| 6,572,742 B1 | | 6/2003 | Cohen | |
| 6,679,980 B1 | * | 1/2004 | Andreacchi | 204/272 |
| 6,730,117 B1 | * | 5/2004 | Tseng et al. | 623/1.16 |

OTHER PUBLICATIONS

Hartmut Surmann et al., Automatic Electropolishing of Cobalt Chromium Dental Cast Alloys with a Fuzzy Logic Controller, Computers Chem. Engng. vol. 22, No. 7–8. pp. 1099–111, 1998 (Copyright) 1998 Elsevier Science Ltd.

* cited by examiner

*Primary Examiner*—Roy King
*Assistant Examiner*—Harry D. Wilkins, III
(74) *Attorney, Agent, or Firm*—Fulwider Patton Lee & Utecht, LLP

(57) ABSTRACT

An apparatus and process is disclosed for the electrolytic removal of metal from a device, such as a medical device. More particularly, the apparatus of the invention includes a mandrel having slots or openings therein to expose portions of a metallic device, such as a stent, to an electrolytic solution to remove metal from the exposed portion.

25 Claims, 4 Drawing Sheets

10
12
13
14
16
18
20
22
24
26

APPARATUS AND PROCESS FOR ELECTROLYTIC REMOVAL OF MATERIAL FROM A MEDICAL DEVICE

BACKGROUND OF THE INVENTION

The invention relates generally to providing an apparatus and process for electrolytic removal of material from products made from metallic alloys. More particularly, the invention relates to electrolytic removal of material from medical devices made of metallic alloys, and even more particularly, the invention relates to an apparatus and process for electrolytic removal of material from stents formed from a metallic alloy. The invention includes an apparatus and electrolytic solution, the process of electrolytic removal of material from a metallic stent using the apparatus, and a coil-link stent selectively treated using the apparatus and solutions.

Stents are generally metallic tube shaped intravascular devices which are placed within a blood vessel to structurally hold open the vessel. The device can be used to maintain the patency of a blood vessel immediately after intravascular treatments and can be used to reduce the likelihood of development of restenosis. Expandable stents are frequently used as they may travel in compressed form to the stenotic site generally either crimped onto an inflation balloon or compressed into a containment sheath in a known manner.

Expandable stents formed from metal offer a number of advantages and are widely used. Metallic, serpentine-shaped stents, for example, not only provide strength and rigidity once implanted, they also are designed to be sufficiently compressible and flexible for traveling through the tortuous pathways of the vessel (or artery) prior to arrival at the stenotic site.

It is highly desirable for the surface of the stent to be extremely smooth so that it can be inserted easily and experience low-friction travel through the tortuous vessel pathway prior to implantation. A roughened outer surface may result in increased frictional obstruction during insertion and excess drag during travel to the stenotic site as well as damaging the endothelium lining the vessel wall. A rough surface may cause frictional resistence to such an extent as to prevent travel to desired distal locations. A rough finish may also cause damage to the underlying inflation balloon. A less rough finish decreases thrombogenicity and increases corrosion resistance.

Stents have been formed from various metals including stainless steel, tantalum, titanium, platinum, nickel-titanium which is commonly called nitinol, and alloys formed with cobalt-chromium. Stainless steel has been extensively used to form stents and has often been the material of choice for stent construction. Stainless steel is corrosion resistant, strong, yet may be cut into very thin walled stent patterns.

Cobalt-chromium alloy is a metal that has proven advantages when used in stent applications. Stents made from cobalt-chromium alloy may be thinner and lighter in weight than stents made from other metallic materials, including stainless steel. Cobalt-chromium alloy is also a denser metal than stainless steel. Additionally, cobalt-chromium stents are nontranslucent to certain electromagnetic radiation waves, such as X-rays, and, relative to stainless steel stents, provide a higher degree of radiopacity, thus being easier to identify in the body under fluoroscopy.

Metal stents, however, suffer from a number disadvantages. They often require processing to eliminate undesirable burrs, nicks, or sharp ends. Expandable metal stents are frequently formed by use of a laser to cut a framework design from a tube of metal. The tubular stent wall is formed into a lattice arrangement consisting of metal struts with gaps therebetween. Laser cutting, however, typically is at high temperature and often leaves debris and slag material attached to the stent. Such material, if left on a stent, would render the stent unacceptable for implantation. Treatment to remove the slag, burrs, and nicks is therefore required to provide a device suitable for use in a body lumen.

Descaling is typically a first treatment of the surface in preparation for further surface treatment such as electropolishing. Descaling may include, for example, scraping the stent with a diamond file, followed by dipping the stent in hydrochloric acid or a hydrochloric acid mixture, and thereafter cleaning the stent ultrasonically. A successfully descaled metal stent should be substantially slag-free in preparation for subsequent electropolishing.

Further finishing is often accomplished by the well known technique of electropolishing. Grinding, vibration, and tumbling techniques are often not suited to be employed on small detailed parts such as stents.

Electropolishing and etching are electrochemical processes by which surface metal is dissolved. Sometimes referred to as "reverse plating," the electropolishing process actually removes metal from the surface desired to be smoothed. The metal stent is connected to a power supply (the anode) and is immersed in a liquid electrolytic solution along with a metal cathode connected to the negative terminal of the power supply. Current is applied and flows from the stent, causing it to become polarized. The applied current is controlled to control the rate at which the metal ions of the anodic stent are generally removed and diffused through the solution to the cathode.

The rate of the electrochemical reaction is proportional to the current density. The positioning and thickness of the cathode in relation to the stent is important to make available an even distribution of current to the desired portion of the stent sought to be etched.

The straightforward application of current, however, does not necessarily translate to even distribution of current across the entire surface sought to be etched. One important feature to creating an even surface on the desired portion of the part is the formation of current differential during the electropolishing process across the surface. Electropolishing provides varied current density to the surface imperfections such as undulations creating protrusions and valleys on the surface. Current density is highest at high points on the surface and lowest at the low points. The increased current density at the raised points causes the metal to dissolve faster at these points thus leveling the surface while forming a corrosion-inhibiting oxide layer.

What is needed is an apparatus and a process for treating a product or device made of a metallic alloy to selectively remove a portion of a medical device, such as a stent, without removing metal from the remaining portion of the stent. The present invention satisfies these needs.

SUMMARY OF THE INVENTION

The invention is directed to an apparatus and a process for electrolytic removal of metal from a product or device made from a metallic alloy. The invention is particularly useful in removing metal from medical devices such as intravascular stents, medical implants, hip joints, bone screws, guide wires, catheters, and embolic filters. Other products and devices unrelated to the medical device products described herein also will benefit from the apparatus and process when such products or devices are made from metallic alloys. Since the process of the invention is particularly useful for medical devices, and more particularly useful for intravascular stents, the process is described herein with respect to stents, but is not so limited.

More particularly, and in keeping with the invention, metal from selected portions of a stent are electrolytically removed while the remaining portions of the stent remain untreated. In one embodiment, a mandrel is provided in which openings or slots are formed in the tubular wall of the mandrel. One or more stent rings are then mounted onto the mandrel so that the rings are in contact with the outer surface of the mandrel, and bayonet portions of the rings are aligned with the slots or openings in the tubular wall of the mandrel. In order to etch only the bayonet portion of the rings, a polymer coating is placed over the stent rings, ring fixture, and mandrel, and heated to shrink-fit the coating onto the stent rings, ring fixture and the mandrel. The polymer coating has slots or openings that coincide with the pattern of slots or openings in the tubular wall of the mandrel. As each stent ring is mounted on the mandrel, a ring fixture is fitted over the mandrel between each stent ring so that the fixture acts as a jigsaw puzzle piece mating with the pattern of the stent rings. In other words, the ring fixture interdigitates with the stent rings in order to assist with sealing the sides of the stent rings from the electrolytic solution. The ring fixture also has slots or opening that coincide with the slots or openings of the mandrel. In order to etch only the bayonet portion of the rings, a polymer coating is placed over the stent rings, ring fixture, and mandrel, and heated to shrink-fit the coating onto the stent rings, ring fixture and the mandrel. The polymer coating has slots or openings that coincide with the pattern of slots or openings in the tubular wall of the mandrel. Thereafter, the assembly is immersed in an electrolytic solution for a period of time, and at a pre-selected current density, in order to etch the bayonet portion of the stent rings. The polymer is inert to the electrolytic solution and masks the stent rings from the solution while the bayonet portion of rings has metal electrolytically removed. After the bayonet portions of the stent rings have been treated, the stent rings are removed from the mandrel and are subsequently mounted on a second mandrel for an electropolishing process.

In the disclosed embodiment, the mandrel, the stent rings, and the ring fixtures preferably are formed of the same metallic alloy. For example, in one embodiment the mandrel is formed of a cobalt-chromium alloy and the stent rings and ring fixtures are formed of a similar cobalt-chromium alloy. Likewise, in another embodiment the mandrel is formed from a stainless steel alloy while the stent rings and ring fixtures are formed from the same stainless steel alloy.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

The present invention relates generally to the electrolytic removal of metal from selected portions of a device, typically a medical device, while the remaining portions of the device are not treated. More particularly, the present invention is suitable for treating selected portions of a stent for use in the vascular system, such as coronary stents or peripheral stents. The invention, however, is not so limited and has a wide application with respect to medical devices or any products where the surface of the device is to be micromachined without machining the rest of the device.

With the present invention, it is possible to selectively remove metal portions of stent rings that will be used to fabricate an intravascular stent. Typically, coronary stents for example, are laser cut out of a stainless steel or cobalt-chromium tube that is between 0.004 inch and 0.010 inch thick (0.102 and 0.254 mm, respectively). After laser cutting the tube, there are surface burrs, scaling, and other debris from the laser cutting process that must be removed. On this size scale, there are few options to remove material with a high degree of precision. Electrolytic removal of metal has the potential to remove a substantial portion of material on this size scale with good precision and repetitive and predictable results. The present invention discloses a unique and novel technique to localize the effect of the electrolytic solution to specific locations, in order to micro-machine a specific surface or portion of the stent.

Figures 1, 2, 3:
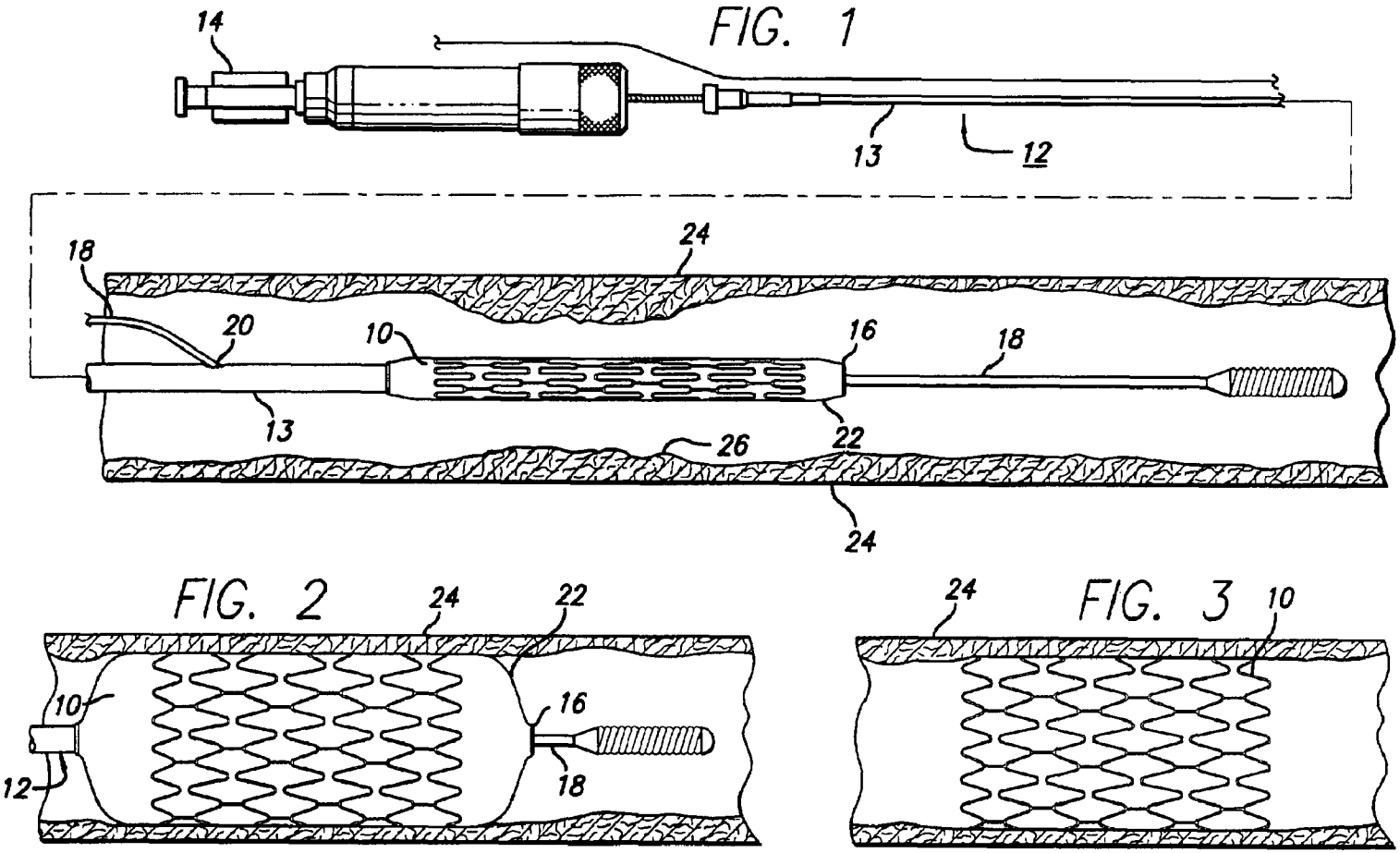
FIG. 1 is an elevational view, partially in section, of a stent mounted on a rapid-exchange delivery catheter and positioned within an artery.
FIG. 2 is an elevational view, partially in section, similar to that shown in FIG. 1, except that the stent is expanded within the artery so that the stent embeds within the arterial wall.
FIG. 3 is an elevational view, partially in section, showing the expanded stent implanted within the artery after withdrawal of the rapid-exchange delivery catheter.

Before describing in detail an exemplary embodiment of a stent made in accordance with the present invention, it is instructive to briefly describe a typical stent implantation procedure and the vascular conditions which are typically treated with stents. Turning to the drawings, FIG. 1 depicts stent 10 of the present invention mounted on a catheter assembly 12 which is used to deliver the stent and implant it in a body lumen, such as a coronary artery, peripheral artery, or other vessel or lumen within the body. The catheter assembly includes a catheter shaft 13 which has a proximal end 14 and a distal end 16. The catheter assembly is configured to advance through the patient's vascular system by advancing over a guide wire 18 by any of the well known methods of an over the wire system (not shown) or a well known rapid exchange catheter system, such as the one shown in FIG. 1.

The catheter assembly 12, depicted in FIG. 1, is of the well known rapid exchange (RX) type which includes an RX port 20 where the guide wire 18 will exit the catheter. The distal end of the guide wire 18 exits the catheter distal end 16 so that the catheter advances along the guide wire on a section of the catheter between the RX port 20 and the catheter distal end 16. As is known in the art, the guide wire lumen which receives the guide wire is sized for receiving various diameter guide wires to suit a particular application. The stent is mounted on the expandable member 22 (balloon) and is crimped tightly thereon so that the stent and expandable member present a low profile diameter for delivery through the arteries.

As shown in FIG. 1, a partial cross-section of an artery 24 is shown with a small amount of plaque 26 that has been previously treated by an angioplasty or other repair procedure. The stent 10 of the present invention is used to repair a diseased or damaged arterial wall which may include the plaque 26 as shown in FIG. 1. The stent of the invention is configured to repair the vessel having plaque.

In a typical procedure to implant the stent 10, the guide wire 18 is advanced through the patient's vascular system by well known methods so that the distal end of the guide wire is advanced past the plaque or diseased area 26. Prior to implanting the stent, the cardiologist may wish to perform an angioplasty procedure or other procedure (i.e., atherectomy) in order to open the vessel and remodel the diseased area. Thereafter, the stent delivery catheter assembly 12 is advanced over the guide wire so that the stent is positioned in the target area. The expandable member or balloon 22 is inflated by well known means so that it expands radially outwardly and in turn expands the stent radially outwardly until the stent is apposed to the vessel wall. The expandable member is then deflated and the catheter withdrawn from the patient's vascular system. The guide wire typically is left in the lumen for post-dilatation procedures, if any, and subsequently is withdrawn from the patient's vascular system. As depicted in FIG. 2, the balloon is fully inflated with the stent expanded and pressed against the vessel wall, and as shown in FIG. 3, the implanted stent remains in the vessel after the balloon has been deflated and the catheter assembly and guide wire have been withdrawn from the patient.

Stent 10 serves to hold open the artery after the catheter is withdrawn, as illustrated by FIG. 3. Due to the formation of the stent from a tubular member, the undulating components of the stent are relatively flat in transverse cross-section, so that when the stent is expanded, it is pressed into the wall of the artery and as a result does not interfere with the blood flow through the artery. The stent is pressed into the wall of the artery and will eventually be covered with smooth muscle cell growth, which further minimizes blood flow interference. The undulating portion of the stent provides good tacking characteristics to prevent stent movement within the artery.

In keeping with the invention, and as shown in FIGS. 4A to 9, an assembly for treating selected portions of a medical device are disclosed. More particularly, the assembly of the present invention is particularly well suited for electrolytically removing portions of a stent, and in that regard, the assembly will be described in connection with treating a stent. The assembly as described herein, however, is not so limited and can be used for etching any number of devices, including medical devices such as stents, medical implants, hip joints, bone screws, guidewires, catheters, anastamosis clips, and embolic filters.

In general terms, as shown in the drawings, the present invention consists of an apparatus and electrolytic solution for electrolytically removing metal from a portion of a stent. The apparatus includes several basic component parts including a mandrel having slots or openings, one or more stent rings mounted on the mandrel with portions of the stent rings aligned with the slots or openings, a, ring fixture that interdigitates with the stent rings to protect the sides of the rings from electrolytic solution, and a polymer coating over the mandrel, stent rings and ring fixture in order to protect them from the electrolytic solution. The assembly is then immersed in the electrolytic solution so that that portion of the stent that is exposed in the slots or openings of the mandrel are exposed to the electrolytic solution whereby metal is selectively removed in a predetermined manner. The component parts of the assembly are described below.

Figure 4A:
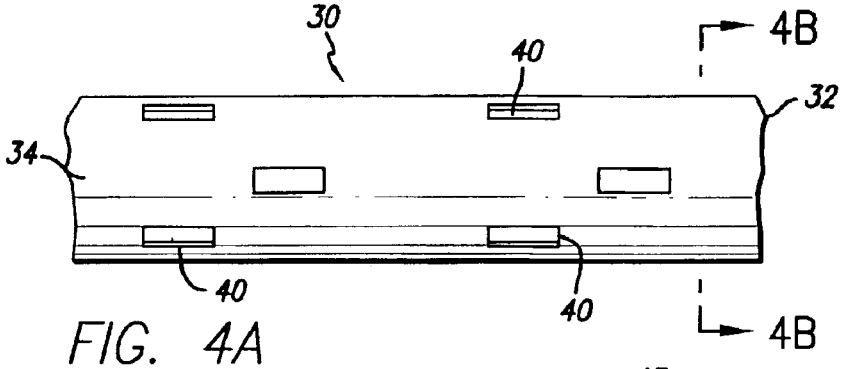
FIG. 4A is a side view of a mandrel for use in the electrolytic removal of material from a medical device.
Figure 4B:
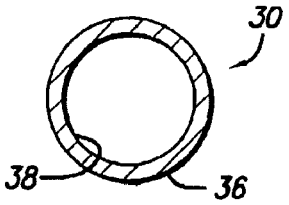
FIG. 4B is a cross-sectional view taken along line 4B—4B depicting the inner and outer surface of the mandrel.

One component part of the assembly includes a hollow mandrel 30, as shown in FIGS. 4A and 4B. The mandrel has a distal end 32 and a proximal end 34 with an outer surface 36 and an inner surface 38 extending therebetween. The mandrel includes slots or openings 40 that can be cut into the mandrel by use of a laser (not shown), which process will be described more fully herein. The shape of the slots or openings, and their size, will depend upon that portion of the device, such as a stent, that is intended to be treated.

Figure 5:
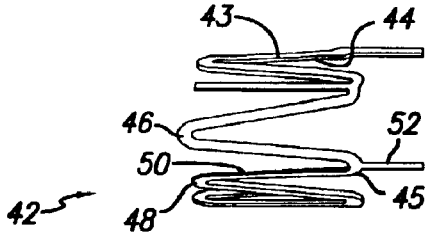
FIG. 5 is a side view of a single stent ring prior to having metal removed by the electrolytic removal process.

The assembly of the invention also includes a stent ring (or a first portion) 42 which is cylindrical and has an outer surface 43 and an inner surface 44, as shown in FIG. 5. The stent ring includes a closed ring configuration of peaks 45 and valleys 46 which typically include undulations 48 which are simply bends or curves that zig zag back and forth. Struts 50 connect the undulations to complete the stent ring structure. In this embodiment, a bayonet (or second portion) 52 is attached to the stent ring and can be manufactured separately, or more typically, is laser cut as part of the stent ring. More particularly, the stent ring can be laser cut from a hollow tubular member, as shown in FIG. 5, with bayonet 52 extending from one of the peaks 45 or undulations 48. As will be more fully described herein, it is the bayonet or second portion 52 that will be exposed to the electrolytic solution while the remaining stent ring 42 is not treated.

Since there are a limited number of metal alloys from which stents are made, it is important to describe several specific alloys for purposes of the present invention. Stents typically are made from stainless steel alloys, such as 316L stainless steel, or other alloys such as cobalt-chromium, nickel-titanium, and the like. For the present invention, if the stent 10 is made from stainless steel, then the hollow mandrel 30 also should be made from the same stainless steel alloy. Similarly, if the stent 10 is formed from a cobalt-chromium alloy, the mandrel 30 should be formed from cobalt-chromium alloy. During the metal removal process, it is desirable to have metal removed from all exposed surfaces at the same rate. Even though the rate of metal removed from the bayonet 52 of the stent ring 42 typically will be greater than the mandrel slots or openings 40, it remains important to try to match the etching rate of the exposed surfaces for better control of current density. The metal alloy of the mandrel and the stent rings does not necessarily have to be the same as long as the mandrel is formed of a conductive metal that has an etching affinity similar to that of the stent rings to ensure the metal removal rate is comparable.

Figure 6A:
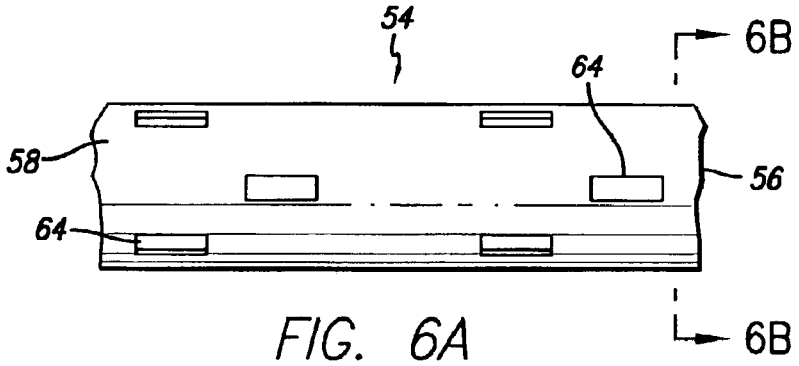
FIG. 6A is a side view of a hollow polymer tube showing openings or slots in the surface thereof.
Figure 6B:
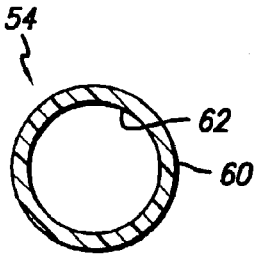
FIG. 6B is a cross-sectional view taken along line 6B—6B showing the inner and outer surfaces of the polymer tube of FIG. 6A.

In further describing the assembly of the invention, as shown in FIGS. 6A and 6B, a polymer tubing 54 is provided to cover the stent ring to prevent it from being exposed to the electrolytic solution, while selectively permitting the bayonet 52 to be exposed. The polymer tubing has a distal end 56, a proximal end 58, and an outer surface 60 and an inner surface 62 that extend between the proximal end and the distal end. The thickness of the polymer tubing is defined by the distance between the outer surface and the inner surface, and can vary for a particular application. Typically, the polymer tubing has a thickness in the range of about one mil (0.0001 inch–0.0025 mm) to about ten mils (0.01 inch–0.25 mm), however these ranges can vary widely depending upon a particular application. The polymer tubing also includes slots or openings 64 that coincide with the mandrel slots or openings 40. The polymer tubing slots or openings 64 preferably have the same shape and size as the mandrel slots and openings 40, and are positioned on the polymer tubing so that when the polymer tubing is placed over the mandrel, the polymer tubing slots or openings 64 align with the mandrel slots or openings 40. The polymer tubing is mounted over the stent rings 42 and then heated to shrink fit over the rings and mask the rings from an electrolytic solution. The polymer tubing slots or openings 64 align with the mandrel slots or openings 40 to expose the bayonet or second portion 52. The polymer tubing can be made from any number of polymer materials including polyesters, low density polyethylene (LDPE), polyethylene terephthalate (PET), polytetrafluroethylene (PTFE), acetal copolymer/homopolymer, acrylonitrile butadiene styrene (ABS), polycarbonate, nylon, polyamide, polyimide, polyacrylate, polyaryl sulfone, polyetherketone, polyetherimide, polyether sulfone, polyphenylene oxide, polyphenylene sulfide, polypropylene, polysulfone, polyurethane, polyvinyl chloride, and styrene acrylonitrile. Generally, any polymer would be suitable for use as the polymer tubing as long as it is inert to an eletrolytic solution used in the metal removing process, and as long as it is flexible enough to be shrunk-fit over the stent ring 42 and the mandrel 30.

Figure 7A:
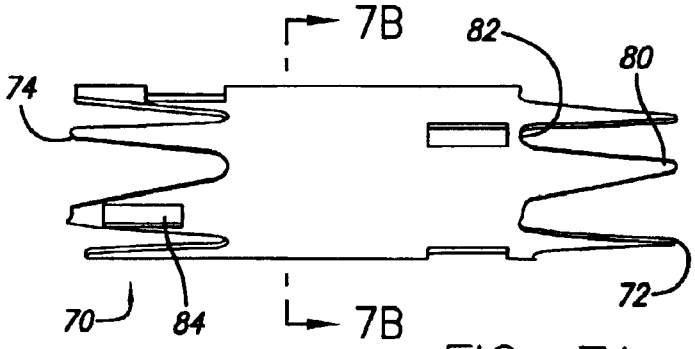
FIG. 7A is a side view of a ring fixture that has ends that are mirror images of the pattern of the ring of FIG. 5.
Figure 7B:
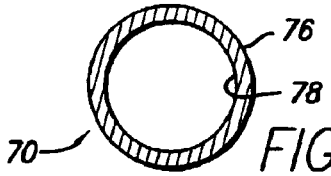
FIG. 7B is a cross-sectional view taken along line 7B—7B depicting the inner and outer surface of the ring fixture of FIG. 7A.

Another component part of the assembly, ring fixture 70, is shown in FIGS. 7A and 7B. The ring fixture is formed of a metallic tubular member having a pattern on each end that is the mirror image of the stent ring 42. More particularly, as shown in FIGS. 7A and 7B, the ring fixture has a distal end 72, a proximal end 74, and an outer surface 76 and inner surface 78 that extend therebetween. At the ends of the ring fixture are peaks 80 and valleys 82 that correspond with and are configured to align with the peaks 45 and valleys 46 of stent ring 42. Further, the ring fixture has slots or openings 84 that correspond with and align with the mandrel slots or openings 40 and the polymer tubing slots or openings 64. It is possible that the polymer tubing 54, when it is shrunk-fit over the stent rings 42 and the mandrel 30, will not provide a tight seal and expose the edges of the stent ring to the electrolytic solution. Accordingly, the ring fixture 70 is mounted on the mandrel and fitted or interdigitated with each stent ring as it is mounted onto the mandrel so that the ring fixture protects the sides of the stent rings from any electrolytic solution that may seep through the polymer tubing. The ring fixture is analogous to a jigsaw puzzle, where a ring having a specific pattern is positioned on the mandrel, and the mating jigsaw puzzle part or ring fixture is positioned to interdigitate with the stent ring, similar to a jigsaw puzzle piece. The ring fixture preferably has the same radial thickness as that of the stent rings. After a series of stent rings and ring fixtures are positioned on the mandrel, the polymer tubing 54 is heated to shrink fit over the stent rings, mandrel and ring fixtures to provide a tight seal and mask the component parts from the electrolytic solution. In this embodiment, the only parts exposed to the electrolytic solution will be the bayonet or second portion 52 of the stent ring, and the edges of the mandrel slots or openings 40 and the edges of the slots or openings 84 of the ring fixture.

Figure 9:
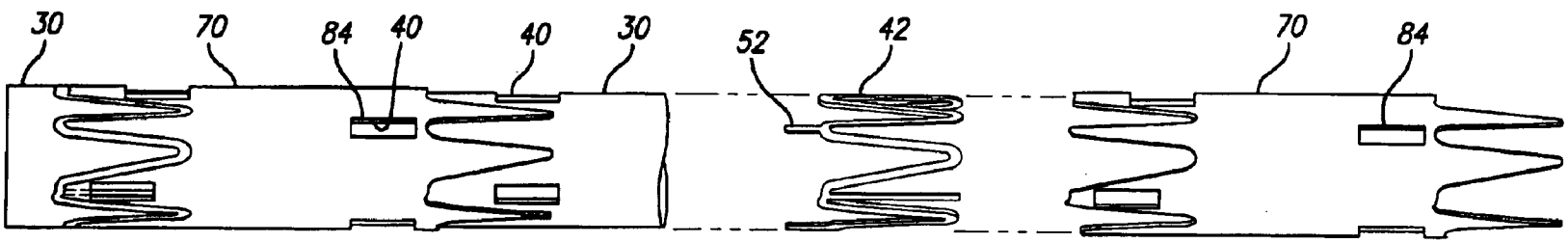
FIG. 9 is a partially exploded view of the apparatus of the invention depicting the mandrel with a stent ring and ring fixture mounted thereon, and a stent ring and ring fixture about to be mounted on the mandrel.

In an embodiment similar to that shown in FIG. 9, the distal end and the proximal end of the mandrel 30 are not covered by the polymer tubing 54, thereby providing a shoulder of exposed metal alloy of the mandrel. The shoulder functions both as a conductivity contact location and as a current sink to control current density at the bayonets or second portions 52.

In the metal removing process, the stent rings become the anode in an electrolytic cell. The stent rings are mounted onto the mandrel which is connected to a power supply. The surrounding solution acts as an electrolyte, and material removal takes place by the application of an external current. Simplistically, the three main factors that control the rate of material removal are (1) the current density at the sample; (2) the geometric relationship between the anode and the cathode; and (3) mass transfer rate of ion removal from the surface of the metal. One approach to affecting the mass transfer rate of ions from the surface of the stent rings is to create a physical barrier between the surface of the stent rings and the electrolytic solution, effectively masking the stent rings at selected places or portions. The aforementioned component parts of the assembly, when assembled as described below, provide selective material removal or micro-machining of the bayonet portion of the stent ring, while protecting the remainder of the stent ring from the electrolytic solution.

Figure 8:
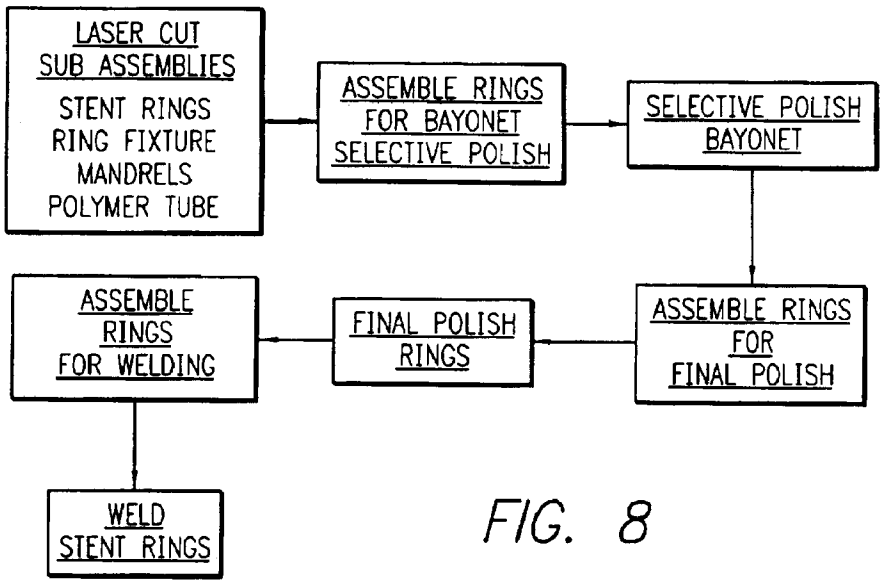
FIG. 8 is a schematic showing the process steps for the electrolytic removal from a stent ring.

In keeping with the invention, and as shown in the schematic of FIG. 8, the process for selectively removing metal from a portion of the stent ring is described. Typically, the subassemblies, which include the hollow mandrel 30, the stent ring 42, the polymer tubing 54, and the ring fixture 70, can be formed by laser cutting the various patterns described above. For example, the hollow mandrel 30 has mandrel slots or openings 40 that are laser cut with a high degree of precision and which are sized and spaced so that they will align with one or more stent rings 42 when mounted on the mandrel. Likewise, the stent rings typically are laser cut from tubing in any number of patterns as described above.

Again referring to FIG. 8, and is illustrated in FIG. 9, after the subassemblies are laser cut, one or more stent rings 42 are mounted on the mandrel 30 by aligning the bayonet or second portion 52 of the stent ring with the slots or openings 40 in the mandrel. The stent rings are mounted onto the mandrel so that there is a metal-to-metal contact, which ensures a good conductive contact between the stent ring and the metallic mandrel. As previously stated, the stent ring and the mandrel should be formed of the same metal alloy, such as stainless steel or cobalt-chromium. Thus, for example, a stainless steel stent ring will be mounted onto a stainless steel mandrel and a cobalt-chromium stent ring will be mounted onto a cobalt-chromium mandrel. As each stent ring is mounted onto the mandrel, a ring fixture 70 is mounted on the mandrel and positioned to interdigitate with the stent rings. The ring fixture will protect the edges of the stent rings from any electrolytic solution that may seep in past the polymer tubing. The ring fixtures have slots or openings 84 that align with the slots or openings 40 of the mandrel so that the bayonet portion of the stent rings continue to be exposed to the electrolytic solution. Once the stent rings and ring fixtures are properly aligned on the mandrel, the entire subassembly is masked or protected from the electrolytic solution by the polymer tubing 54. In order to ensure that only selected portions of the stent rings are micro-machined, the rings are masked by use of the polymer tube. After the rings are mounted onto the mandrel, the polymer tube 54 is mounted over the rings so that the polymer tubing slots or openings 64 are aligned with the mandrel slots or openings 40. The polymer tubing is then heated or otherwise treated so that it tightly shrinks onto the stent rings and completely covers the stent rings, ring fixtures, and the mandrel, except for the slots and openings, which remain open so that the bayonet or second portion 52 of the stent ring is exposed through the slots or openings 40, 64 and 84. While the polymer tubing is tightly shrink-fitted onto the stent rings and the mandrel, there remains a metal-to-metal contact between the stent rings and the mandrel. Thus, the stent ring inner surface 44 is in direct contact with the mandrel outer surface 36 so that there remains a conductive relationship with the mandrel and the stent rings.

Figure 10:
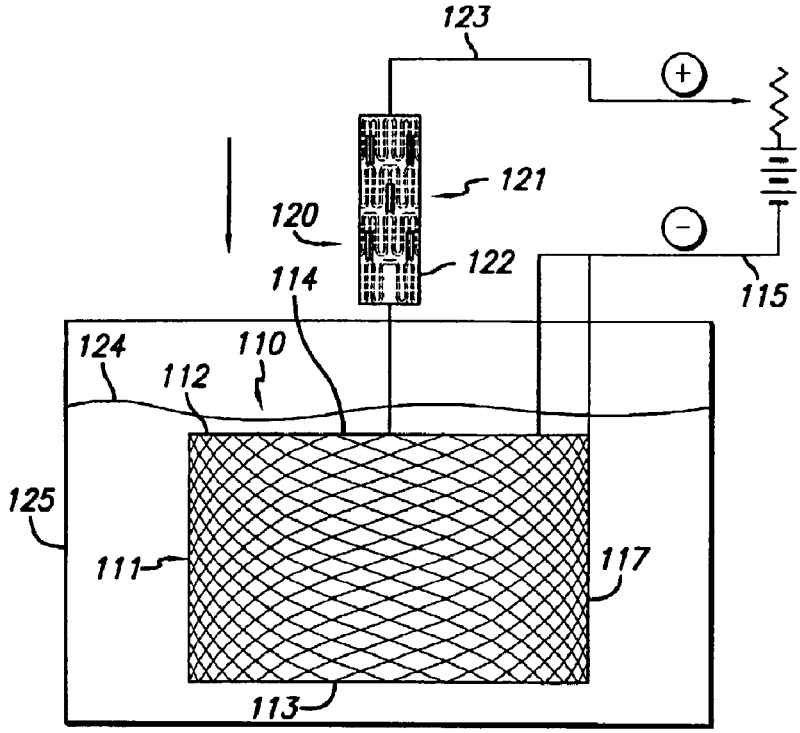
FIG. 10 is a schematic view of the device of the invention prior to being immersed in an electrolytic solution.
Figure 11:
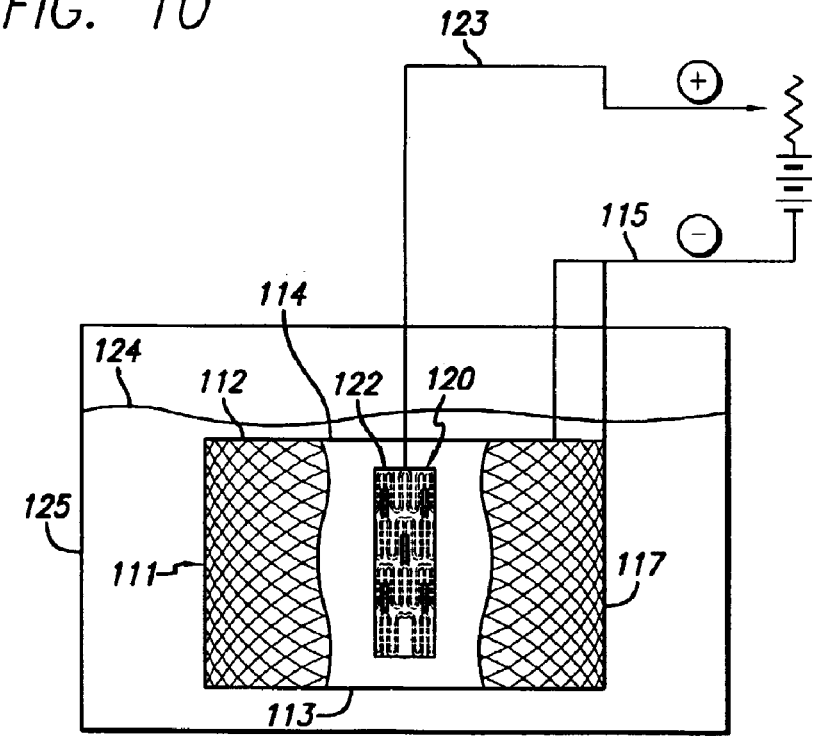
FIG. 11 is a schematic view depicting the device of the invention at least partially surrounded by a cathode and both being immersed in an electrolytic solution.

An apparatus that can be used to selectively remove metal from the stent rings using an electrolytic solution is shown in FIGS. 10 and 11. Configurations other than that shown in FIGS. 10 and 11 are possible to suit particular requirements.

Referring to FIG. 10, a cathode 100 is provided in the form of a tubular member 111. The tubular member has a first end 112 and a second end 113, with an opening 114 extending therethrough from the first end to the second end. In one embodiment as depicted in FIGS. 10 and 11, a wire 115 is attached to a wire mesh tube 117 in which a lattice-type mesh extends substantially from the first end to the second end of the tubular member. In another embodiment, the tubular member 111 is in the form of a wire coil 116 that is generally in the shape of a helix or a spiral. While the tubular member 111 of FIGS. 10 and 11 is in the form of a continuous wire mesh tube 117, the tube can be non-continuous (e.g., two or more arcuate sections with a longitudinal space between sections) and still operate as the cathode. Further, tube 117 can have other configurations such as an hour glass shape or a tapered shape to suit a particular application.

As shown in FIG. 10, an anode 120 is formed by a metallic device 121. For purposes of discussion, and by illustration only, the assembly 122, which includes the stent rings 42 and the ring fixtures 70 mounted on the mandrel 30 with the polymer tubing 54 as a cover, is depicted as forming the metallic device. A current conducting member 123 (such as a wire) is attached to one end of the assembly 122 in order to complete the electrical circuit between the anode and cathode. Importantly, and as shown in FIG. 11, the cathode or tubular member substantially surrounds the anode or assembly 122. For example, the assembly has a length and a diameter such that the length and diameter of the tubular member is greater than the length and diameter of the assembly. As a more specific example, a typical coronary stent can range in length from approximately 6 mm to 40 mm (0.24 to 1.57 inch, respectively) and have an unexpanded diameter in the range of about 1.5 mm to 7 mm (0.06 to 0.28 inch, respectively), depending upon the application. In order to substantially surround the assembly 122, which has similar dimensions to that of the stent, the tubular member should have a length in the range of about 10 to 60 mm (0.39 to 2.36 inch, respectively) and a diameter in the range of about 4 to 70 mm (0.16 to 2.76 inch, respectively). Obviously, these dimensions for the metallic device and the tubular member can vary widely depending upon the application and the size of the metallic device being treated.

In order to accomplish the electrolytic removal of metal from the bayonet 52 of the stent rings, the cathode 10 and anode 120 are submerged in an electrolytic solution. In FIG. 10, the cathode or tubular member 111 is shown submerged in an electrolytic solution 124 which is held in a container 125 that is commonly known. The anode 120 or assembly 122 has not yet been submerged in the electrolytic solution and positioned within the tubular member. As shown in FIG. 11, the metal removing process is commenced when the anode or assembly 122 is positioned within the tubular member, in this case wire mesh tube 117, by positioning the assembly substantially within the wire mesh tube, and then supplying a current.

The tubular member cathode 111 is submerged into the acid mixture so that the tubular member is suspended substantially in the acid. The anodic assembly 122 is then lowered and vertically submerged into the electrolytic acid solution 124 and positioned within the tubular member so that the ends of the assembly are substantially equidistant from the tubular member. The power supply is thereafter energized and adjusted altering the current controller to supply current in the range of about 0.1 amps/sq. ft. to about 10 amps/sq. ft. to the solution for a period of approximately 400 to 600 seconds. The current settings and time can vary widely depending upon a particular application. While the disclosed embodiment shows stent assembly 122 submerged in a vertical orientation, it can be rotated into other orientations such as, for example, from 0° to 90° relative to vertical.

There are numerous electrolytic solutions available for use in the present invention for the electrolytic removal of metal from stent rings. Several solutions are disclosed herein for use with cobalt-chromium stent rings, however, the disclosed embodiments are exemplary and are not intended to be limiting. One solution that can be used to selectively remove metal from the stent rings is a mixture of about six parts of about 98% concentrated sulfuric acid ($H_2SO_4$), about one part of about 37% concentrated hydrochloric acid (HCl), and about one part of 85% concentrated phosphoric acid ($H_3PO_4$) (hereinafter referred to as the "6:1:1 solution"). In another formulation the solution includes a mixture of about six parts of about 98% concentrated sulfuric acid ($H_2SO_4$) and about one part of 85% concentrated phosphoric acid ($H_3PO_4$). In yet another solution, the acidic electrolytic solution comprises about one part by volume of a first component selected from the group consisting of ethylene glycol, ethylene glycol derivatives and mixtures thereof and at least about two parts by volume of a second component that is an acid (hereinafter referred to as the "ethylene glycol solution"). More particularly, this solution may have about one part by volume of the first component that is a mixture of about equal parts by volume of ethylene glycol, ethylene glycol bisthioglycolate and ethylene glycol diacetate and either about three parts by volume of the second component that is about 98% concentrated sulfuric acid or about six parts by volume of the second component that is a mixture of about five parts by volume of 98% concentrated sulfuric acid and about one part by volume of 37% hydrochloric acid or 85% phosphoric acid.

After the stent assembly 122 has been processed in the electrolytic solution, the bayonet or second portion 52 of the stent rings or first portion 42 should be relatively free of any surface imperfections resulting from the laser cutting process. The surface of the bayonet 52 should be smooth and shiny, especially compared to the stent rings which did not get exposed to the electrolytic solution. The stent rings are next removed from the mandrel 30 and subsequently mounted on a second mandrel (not shown) for further processing including electropolishing which is known in the art.

While the invention has been illustrated and described herein, in terms of an apparatus and process for the electrolytic removal of material from a medical device, such as an intravascular stent, it will be apparent to those skilled in the art that the apparatus and process can be used with other devices. Further, other modifications and improvements can be made without departing from the scope of the invention.

What is claimed:

1. An assembly for selectively removing metal from portions of a stent, comprising:

a hollow metallic mandrel having a tubular wall and having an opening formed in the tubular wall;

a stent ring mounted onto the mandrel and aligned so that a first portion of the ring contacts the tubular wall and a second portion of the ring is aligned with the opening in the tubular wall;

a polymer coating for covering the first portion of the ring and the mandrel; and an electrolytic solution for selectively removing metal from the second portion of the ring.

2. The assembly of claim 1, wherein the hollow mandrel is formed from a cobalt-chromium alloy.

3. The assembly of claim 2, wherein the tubular wall has a thickness equal to or greater than a radial thickness of the stent ring.

4. The assembly of claim 2, wherein the stent ring is formed from a cobalt-chromium alloy.

5. The assembly of claim 1, wherein a removable ring fixture is slidably mounted on the mandrel, the ring fixture being configured to interdigitate with the stent ring and insulate the first portion of the ring from the electrolytic solution.

6. The assembly of claim 1, wherein the second portion of the stent ring is a bayonet that is exposed to the electrolytic solution.

7. The assembly of claim 1, wherein the size and shape of the opening in the tubular wall being dependent upon the size and shape of the second portion of the stent ring.

8. The assembly of claim 1, wherein the polymer is inert to the electrolytic solution.

9. The assembly of claim 8, wherein the polymer coating is selected from the group of polymers consisting of low density polyethylene, polytetrafluroethylene, acetal copolymer/homopolymer, acrylonitrile butadiene styrene, polycarbonate, nylon, polyamide, polyimide, polyacrylate, polyaryl sulfone, polyetherketone, polyetherimide, polyether sulfone, polyethylene terephthalate, polyphenylene oxide, polyphenylene sulfide, polypropylene, polysulfone, polyurethane, polyvinyl chloride, and styrene acrylonitrile.

10. The assembly of claim 1, wherein the electrolytic solution comprises a mixture of about six parts of about 98% concentrated sulfuric acid ($H_2SO_4$), about one part of about 37% concentrated hydrochloric acid (HCI), and about one part of 85% concentrated phosphoric acid ($H_3PO_4$).

11. An assembly for selectively removing metal from a medical device, comprising:

a hollow metallic mandrel having a tubular wall and having an opening formed in the tubular wall;

a medical device slidably mounted onto the mandrel and aligned so that the first portion of the medical device contacts the tubular wall and a second portion of the medical device is aligned with the opening in the tubular wall;

a polymer coating for covering the first portion of the medical device not in contact with the mandrel; and an electrolytic solution for selectively removing metal from the second portion of the medical device.

12. The assembly of claim 11, wherein the hollow mandrel is formed from a cobalt-chromium alloy.

13. The assembly of claim 12, wherein the tubular wall has a thickness equal to or greater than a radial thickness of the medical device.

14. The assembly of claim 12, wherein the medical device is formed from a cobalt-chromium alloy.

15. The assembly of claim 11, wherein the size and shape of the opening in the tubular wall being dependent upon the size and shape of the second portion of the medical device.

16. The assembly of claim 11, wherein the polymer is inert to the electrolytic solution.

17. The assembly of claim 11, wherein the polymer coating is selected from the group of polymers consisting of low density polyethylene, polytetrafluroethylene, acetal copolymer/homopolymer, acrylonitrile butadiene styrene, polycarbonate, nylon, polyamide, polyimide, polyacrylate, polyaryl sulfone, polyetherketone, polyetherimide, polyether sulfone, polyethylene terephthalate, polyphenylene oxide, polyphenylene sulfide, polypropylene, polysulfone, polyurethane, polyvinyl chloride, and styrene acrylonitrile.

18. The assembly of claim 11, wherein the electrolytic solution comprises a mixture of about six parts of about 98% concentrated sulfuric acid ($H_2SO_4$), about one part of about 37% concentrated hydrochloric acid (HCI), and about one part of 85% concentrated phosphoric acid ($H_3PO_4$).

19. An assembly for selectively removing metal from a stent, comprising:

a hollow metallic mandrel having a tubular wall and having an opening formed in the tubular wall;

a plurality of stent rings mounted onto the mandrel and aligned so that the stent rings contact the tubular wall, and a bayonet portion of each ring being aligned with the opening in the tubular wall;

a polymer coating for covering the stent rings and the mandrel, the polymer coating having openings coinciding with the openings in the tubular wall; and an electrolytic solution for selectively removing metal from the bayonet portion of the ring.

20. The assembly of claim 19, wherein the hollow mandrel is formed from a cobalt-chromium alloy.

21. The assembly of claim 19, wherein the stent rings are formed from a cobalt-chromium alloy.

22. The assembly of claim 19, wherein the tubular wall has a thickness equal to or greater than a radial thickness of the stent rings.

23. The assembly of claim 19, wherein a plurality of removable ring fixtures are slidably mounted on the mandrel, the ring fixtures being configured to interdigitate with the stent rings and insulate the first portion of the rings from the electrolytic solution.

24. The assembly of claim 19, wherein the polymer is inert to the electrolytic solution.

25. The assembly of claim 24, wherein the polymer coating is selected from the group of polymers consisting of low density polyethylene, polytetrafluroethylene, acetal copolymer/homopolymer, acrylonitrile butadiene styrene, polycarbonate, nylon polyamide, polyimide, polyacrylate, polyaryl sulfone, polyetherketone, polytherimide, polyether sulfone, polyethylene terephthalate, polyphenylene oxide, polyphenylene sulfide, polypropylene, polysulfone, polyurethane, polyvinyl chloride, and styrene acrylonitrile.

* * * * *